United States Patent [19]

Leifheit

[11] Patent Number: 4,743,395

[45] Date of Patent: May 10, 1988

[54] THICKENED ACID CLEANER COMPOSITIONS CONTAINING QUATERNARY AMMONIUM GERMICIDES AND HAVING IMPROVED THERMAL STABILITY

[75] Inventor: David H. Leifheit, Cincinnati, Ohio

[73] Assignee: The Drackett Company, Cincinnati, Ohio

[21] Appl. No.: 907,569

[22] Filed: Sep. 12, 1986

[51] Int. Cl.[4] ..... C11D 1/62; C11D 7/08

[52] U.S. Cl. ..... 252/106; 252/142; 252/546; 252/547; 252/545

[58] Field of Search ..... 252/106, 546, 547, 142, 252/DIG. 14, 545; 134/41

[56] References Cited

U.S. PATENT DOCUMENTS

| | | | |
|---|---|---|---|
| 3,093,591 | 6/1963 | Freese | 252/106 |
| 3,247,119 | 4/1966 | Herrick et al. | 252/106 |
| 3,681,141 | 8/1972 | Muoio | 134/41 |
| 3,684,722 | 8/1972 | Hynam et al. | 252/98 |
| 3,781,203 | 12/1973 | Clark et al. | 252/8.55 C |
| 3,793,221 | 2/1974 | Otrhalek et al. | 252/136 |
| 3,832,234 | 8/1974 | Otrhalek et al. | 134/4 |
| 4,032,466 | 6/1977 | Otrhalek et al. | 252/136 |
| 4,061,580 | 12/1977 | Jahnke | 252/8.55 R |
| 4,075,350 | 2/1978 | Michaels | 424/316 |
| 4,282,109 | 8/1981 | Citrone et al. | 252/102 |
| 4,302,253 | 11/1981 | Ciullo | 106/208 |
| 4,324,669 | 4/1982 | Norman et al. | 252/8.55 C |
| 4,375,421 | 3/1983 | Rubin et al. | 252/110 |
| 4,388,204 | 6/1983 | Dimond et al. | 252/98 |
| 4,396,525 | 8/1983 | Rubin et al. | 252/174.25 |
| 4,518,519 | 5/1985 | Lott et al. | 252/148 |
| 4,561,993 | 12/1985 | Choy et al. | 252/174.25 |

FOREIGN PATENT DOCUMENTS

| | | |
|---|---|---|
| 1443244 | 7/1976 | United Kingdom . |
| 2071688 | 9/1981 | United Kingdom . |

OTHER PUBLICATIONS

Sherex, "Varion TEG", Technical Bulletin, Sherex Chemical Co.

McCutcheon's, Emulsifiers & Detergents, North American Ed., 1982, pp. 283–284.

Tech. Data, Jorphox Phosphated Amine Oxides, Jordan Chemical Company (undated).

Tech. Data, Varion TEG a Tallon Betaine, Sherex Chemical Company (undated).

*Primary Examiner*—Prince E. Willis

*Attorney, Agent, or Firm*—Charles J. Zeller

[57] ABSTRACT

Thickened hydrochloric acid containing cleaning compositions also including a quaternary ammonium compound are disclosed, said compositions further including a phase stabilizing surfactant selected from the group of alkyl betaines, alkoxylated tertiary amines, ethoxylated alkylphenols, and phosphate esters of amine oxides.

38 Claims, No Drawings

THICKENED ACID CLEANER COMPOSITIONS CONTAINING QUATERNARY AMMONIUM GERMICIDES AND HAVING IMPROVED THERMAL STABILITY

FIELD OF INVENTION

This invention relates to thickened, aqueous, hydrochloric acid-containing compositions useful as hard surface cleaners, especially for cleaning porcelain, ceramic, and tile surfaces. More specifically, the present invention relates to improved thermal stability of such compositions also containing as a germicide cationic quaternary ammonium compounds. The subject compositions have been found to demonstrate improved phase stability at temperatures typically encountered in summer warehousing.

BACKGROUND OF INVENTION

Thickened hydrochloric acid cleaner compositions are known in the art. For example, U.S. Pat. Nos. 3,793,221 and 3,832,234, both to Otrhalek, et al., disclose compositions containing an aqueous hydrochloric acid, an organic acid, a nonionic surfactant, an anionic surfactant, and water, the particular combinations of surfactants disclosed in the Otrhalek, et al., patents exhibiting unusual thickening properties. U.S. Pat. No. 4,302,253 to Ciullo discloses storage stable liquid cleaning compositions for use on porcelain-type surfaces, which compositions comprise an aqueous mineral acid solution thickened with smectite clay and xanthan gum. A stabilizing amount of 1-hydroxy-ethyl-2-amidoimidazoline is included in the compositions of Ciullo so that they retain their initial viscosity during their shelf life. U.S. Pat. No. 3,681,141 to Muoio concerns a process for cleaning hard surfaces such as porcelain and enamel surfaces by applying to such surfaces a viscous, fluid composition consisting essentially of water, a mineral acid, and a water-soluble synthetic organic polymer, e.g., polymers selected from the group consisting of polyvinyl alcohol and polyethylene glycol. U.S. Pat. No. 4,561,993 to Choy, et al., discloses a thixotropic acid-abrasive cleaner comprising about 6 to 12% precipitated silica; about 0.05 to 2.5% cationic, nonionic, or zwitterionic or amphoteric surfactant, or mixtures thereof, the surfactant having hydrogen bonding ability; an acid, and an abrasive. Viscosities obtained are typically quite high, in the order of 4,000–20,000 centipoise. An exemplary cationic surfactant disclosed in Choy, et al., is dialkyl dimethyl ammonium chloride, which desirably has disinfectant properties. Brit. Pat. No. 1,443,244 to Reckitt and Colman concerns an acid cleaning composition containing hydrochloric acid; a second acid such as phosphoric acid; a thickener; acid stable detergents, and water. The thickening agent incorporated in the Brit. Pat. No. 1,443,244 compositions is an ethoxylated or propoxylated tertiary amine of the formula

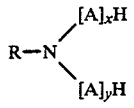

wherein R is an alkyl or alkenyl derived from a fatty acid or an alkaryl having 8 to 12 carbons in the alkyl; A is ethoxy or propoxy, and x and y are integers of from 1 to 3. A quaternary ammonium compound such as benzyldodecyltrimethyl ammonium chloride may be incorporated as a baceticide. U.S. Pat. No. 4,396,525 to Rubin, et al., discloses an acid-free aqueous liquid scouring composition containing an anionic surfactant and an alkylamido betaine as a cosurfactant, the Rubin, et al., compositions having satisfactory storage stability as indicated at column 6, Table 3. The betaine constituent of Rubin, et al, is a replacement for nonionic cosurfactants of the prior art, that is alkanolamines, amine oxides, and ethoxylated fatty alcohols. Technical Data Sheet: Varion TEG 2, Sherex Chemical Company, Inc. (1984) discloses Varion TEG, a 41–44% active solution of dihydroxyethyl tallow glycinate as a thickener for hydrochloric acid/phosphoric acid solutions, alone or in combination with Varonic T-202, a polyethylene glycol amine of hydrogenated tallow having an average of 2 moles ethylene glycol per molecule.

Cleaner compositions to be used in the cleaning of porcelain and other such surfaces advantageously should include a bactericidal amount of a quaternary ammonium compound having as a substituent group a benzyl radical. Inclusion of such beneficial bactericides in thickened hydochloric acid compositions has been found to have a destabilizing effect on the compositions at the higher temperature that would be encountered during summer warehouse storage.

In investigating this problem, it was found, quite surprisingly, that certain cosurfactants selected from the group consisting of alkyl betaines; alkoxylated tertiary amines; ethoxylated nonyl phenols, and phosphate esters of amine oxides substantially improve the thermal stability of thickened hydrochloric acid compositions containing the aforementioned quaternary compound.

Accordingly, it is an object of this invention to provide an aqueous, thickened composition containing hydrochloric acid and a quaternary benzyl ammonium compound.

It is a primary object of the present invention for such compositions to exhibit good storage stability at elevated temperatures.

These and other objects, advantages, and benefits of the present invention will be more fully understood by reference to the complete specification provided herein.

SUMMARY OF THE INVENTION

The hydrochloric acid-containing composition of the present invention comprises an aqueous solution of the acid; an organic thickener agent compatible with the acid; a phase stabilizing surfactant selected from the groups consisting of alkyl betaines, alkoxylated tertiary amines (as hereinafter further described), alkoxylated alkyl phenols having an HLB value of about 13 or less, and phosphate esters of amine oxides, and one or more quaternary ammonium compounds having a benzyl or alkylbenzyl substituent group. The thickener agent, present in amount effective to provide a viscosity of 25 centipoise or greater, is preferably dihydroxyethyl tallow glycinate, while the preferred phase stabilizing surfactant is coco dimethyl betaine. Other suitable phase stabilizing surfactants include coco diethoxylated tertiary amine having an average of about 2 to about 5 moles ethylene oxide per molecule; ethoxylated octyl or nonyl phenols, and N,N-bis(hydroxyethyl) coco amine oxide phosphate ester, especially its potassium salt. The phase stabilizing surfactant lessens the tendency of the thickened acid composition containing the quaternary from separating into two phases during storage at elevated temperature, and is characterized by a cloud point of about 125° F. or greater.

DETAILED DESCRIPTION OF THE INVENTION

The compositions of the present invention are suitable for cleaning various hard surfaces such as porcelain, ceramic tiles, and other acid-resistant surfaces. Such compositions have a viscosity typically above 25 centipoise, preferably from about 60 to 800 centipoise, most preferably, from about 100 to about 300 centipoise. Because of their viscous nature, they are quite suitable for cleaning vertical tile walls. The compositions are also quite suitable as a toilet bowl cleaner that is dispensed from a suitable container onto that portion of the bowl beneath its rim but above the bowl water level. The viscous nature of the composition causes it to cling to the typically sloping bowl surface, and allows the consumer time to complete cleaning with a brush.

A problem associated with thickened surfactant-containing acid cleaner compositions is their tendency, in view of ionic interactions between the acid, thickener, and surfactant constituents, to separate into two distinct phases over time and at elevated storage temperatures, such as encountered during summer warehouse storage.

Compositions of the subject invention are deemed to have suitable summertime storage stability if there is no phase separation over a period of 28 days at 125° F. In addition, the viscosity should preferably not fluctuate widely from the initial viscosity, the variation preferably being not greater than ±40%. The acceptability of a composition of the present invention at the time of its use by a consumer depends, however, not on a preferred or desirable viscosity value, but rather on its suitability to perform the requisite cleaning function.

The composition of the present invention comprises (a) hydrochloric acid; (b) a mineral acid compatible thickener; (c) a quaternary ammonium compound; (d) a phase stabilizing surfactant, and (e) water, said constituents and their concentrations being described in greater detail below.

Unless otherwise indicated, all concentrations recited herein are by weight of the total composition. All percents of the constituents are based on 100% activity thereof; i.e., undiluted by solvents or other diluents.

The acid component (a) is hydrochloric acid, which is present in an amount of from about 3 to about 25%, on a 100% HCl basis. This acid is a powerful cleaning agent for removing rust stains, and is also quite an acceptable agent for attacking hard water and microbiological deposits. It also provides a disinfecting function to the composition. Preferably, the HCl concentration is in the range of from about from about 6 to about 15%, most preferably between 6 to 10%.

Thickeners suitable for use in the compositions of the present invention include organic thickener compound selected from the group consisting of (a) dihydroxy($C_1$-$C_3$alkyl) ($C_{16}$-$C_{22}$alkyl) glycinates, (b) alkoxylated tertiary amines of the formula

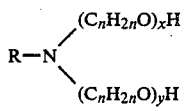

(I)

wherein R is an alkyl or a alkenyl group of from 16 to 22 carbons, n is an integer of from 2 to 3, and x and y are integers of from 1 to 3, the average value of x+y in the molecule being 3 or less, and (c) mixtures thereof. The preferred thickener is dihydroxyethyl tallow glycinate and is manufactured as Varion TEG manufactured by Sherex Chemical Company, as Miratainе TM by Miranol Chemical Company and as Monateric 1202 by Mona Industries, Inc. Also suitable is Mona AT-1200. The preferred thickener (b) represented by structural formula (I) has as the substituent group R a tallow radical, x+y having an average value in the molecule of about 2, e.g., Ethomeen T/12 by Armak Company and Varonic T202 by Sherex Chemical Company.

The thickener is present in an amount effective to provide the requisite viscosity of the composition, and is typically present in an amount of from about 0.1 to about 5% by weight. Preferably, the thickener is present in an amount of from about 1 to about 4%, most preferably from 1.5 to 3%. The thickener may be added as a 100% material or as an aqueous solution, with heating possibly required to melt solid material or to reduce viscosity of liquids to a suitable level. Thus, for example, Mona AT-1200 is a 30–35% by weight aqueous solution of active thickener having 41% by weight total solids. Advantageously, the preferred dihydroxyethyl tallow glycinate effectively inhibits the corrosive attack of the acids present.

The quaternary ammonium compound incorporated in the composition of the present invention has the chemical structure $[R_1R_2R_3R_3N]^+X^-$ wherein $R_1$ is an alkyl of from about 12 to about 18 carbons; $R_2$ is a benzyl or alkyl benzyl, the alkyl having 1 to about 3 carbons; $R_3$ is an alkyl of from 1 to 3 carbons, and X is a halide anion, preferably chloride. Preferred quaternaries are n-alkyl ($C_{12}$–$C_{18}$) dimethyl benzyl and ethylbenzyl ammonium chlorides, especially wherein the alkyl is lauryl and, most preferably the quaternary component comprises a mixture thereof, especially in the weight ratio range of 4.5:1 to 1:4.5. The quaternary is present in a germicidally effective amount, typically from about 0.1 to about 1.0% by weight of the composition, most preferably from about 0.5 to about 0.75%.

It has been found that inclusion of the quaternary negatively affects the thermal stability of the composition. For this reason, it is necessary to include the stabilizing surfactant agent. The phase stabilizing surfactant agent is selected from the group consisting of alkyl betaines, alkoxylated tertiary amines, alkoxylated alkyl phenols, and phosphate esters of amine oxides, as described in greater detail below.

The alkyl betaines have the formula

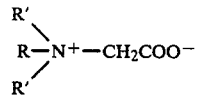

(II)

wherein R is an alkyl of from about 12 to 16 carbons, preferably from 12 to 14 carbons, and R′ is methyl or ethyl, preferably methyl. Exemplary of this type of surfactant are Lonzaine 12C and Lonzaine 14 manufactured by Lonza Corporation and Varion CDG manufactured by Sherex Chemical Company, wherein R is $C_{12}$ to $C_{14}$ and R′ is methyl.

The alkoxylated tertiary amines have the formula

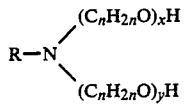

(III)

wherein R is an alkyl or alkenyl of from about 12 to about 18 carbons, n is an integer of 2 to 3, preferably 2, and x and y are integers from 1 to about 5, the sum of x and y having an average value of from about 2 to about 5 when R has from about 12 to 14 carbons and an average value of about 5 when R has from 15 to about 18 carbons. Exemplary are Ethomeens C/12, C/15, O/15, and T/15 manufactured by Armak Industries, Inc. and Varonic K202 and K205 manufactured by Sherex Chemical Company. Preferably R is coco.

The alkoxylated alkyl phenols include compounds having the structural formula

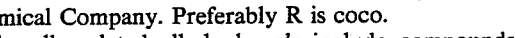

(IV)

wherein R is an alkyl of from 6 to 10 carbons, preferably 8 or 9, and n has a value such that the HLB of the compound is about 13 or less, preferably in the range of from about 9 to 13.

Phosphate esters of amine oxides suitable for use as the phase stabilizing surfactant include compounds having the chemical structure

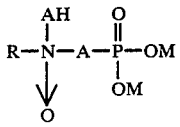

(V)

wherein R is an alkyl of from 12 to 18 carbons; A is $(C_nH_{2n}O)_m$, n having a value of from 2 to about 3, preferably 2, and m having a value of from 1 to about 5, preferably 1, and M is hydrogen or an alkali metal or ammonium cation. An exemplary amine oxide phosphate ester is Jorphox KCAO manufactured by Jordan Chemical Company, wherein R is coco, n=2, m=1, and M is potassium.

The phase stabilizing surfactant constituent is included in the composition in an amount effective to prevent separation of the composition into phases. It is believed that the phase stabilizing surfactant, when included in an effective amount, operates to provide a phase stabilized composition by raising its cloud point, a composition having a cloud point typically above about 125° F. being suitable. Preferably, the cloud point of the composition is above about 140° F. The amount of phase stabilizing surfactant is typically in the range of from about 0.05 to about 2.5%, preferably from about 0.15 to about 1.0%, by weight of the composition, although it is to be realized that a degree of experimentation might be beneficial in establishing optimum stabilizing concentrations.

In this regard, it is noted that not all of the above-mentioned phase stabilizing surfactants are equally effective per unit weight. Thus, it has been found that Varion CDG, a cocodimethyl betaine manufactured by Sherex Chemical Company, is quite effective, and the effective level of Varion CDG is less than the other phase stabilizing surfactants mentioned above, preferably on the order of from about 0.15 to about 0.50% by weight of the composition on an active-ingredient basis. Jorphox KCAO, an amine phosphate ester, is also a preferred phase stabilizing surfactant.

It is surprising that the above-mentioned phase-stabilizing surfactants operate to prevent phase separation at elevated temperatures in that other surfactants were found to be ineffective. Thus, cocoamidopropyl betaine (Monateric ADA); cocoamidopropyl sulfobetaine (Lonzaine CS); cocoamphopropionate (Monateric CEM-38%); oleoamphopropionate (Miranol OM-SF); oleoamphopropyl sulfonate (Miranol OS-D), and ethoxylated primary alcohol (Alfonic 610-50) did not demonstrate efficacy, as shown in Examples 2 and 3.

Similarly, hydroxyethyl oleyl imidazoline (Monazoline O); a tris-imidazoline triquaternary phosphate ester (Monaquet PT-Z), and an amphoteric phosphate ester (Phosphoteric T-C6) did not demonstrate the requisite stabilizing activity. Jordamox LDA, a lauryl dimethyl amine oxide, was not effective.

Optional ingredients that may be incorporated in the acid compositions of the present invention include acid stable dyes, pigments, and lakes; perfumes; chelating and sequestering agents; buffers, and the like. These optional materials should be compatible in the composition and at the level at which they are present therein. Typically, the concentration of each of the optional ingredients will be less than 2%, preferably less than 1%, by weight of the composition. Abrading agents, fillers and diluents may also be included in effective concentration levels.

The following Examples further delineate the present invention and provide an additional basis for understanding same. Unless noted, all ingredients are on a 100% active basis.

EXAMPLE 1

Compositions of the formula recited in Table I were tested for their elevated temperature stability by storage at 125° F. for 28 days and/or by determination of the cloud point thereof. The storage test samples were evaluated by visual inspection. Storage test samples that were characterized by a cloudy appearance or by separation into two phases were regarded as unstable. Cloud point was measured by ASTM D2024-65. Although ASTM D2024-65 is intended for compositions containing 0.5–1.0% by weight nonionic surfactant at 30° C. or greater, it was found to accurately measure the solubility inversion temperatures of the compositions tested. The determinations were made on the undiluted compositions using a water bath for temperature control. A cloud point of about 125° F. or greater is deemed characteristic of stability. The results are provided in Table II.

TABLE I

| Component | % by Weight |
|---|---|
| Dihydroxyethyl tallow glycinate | 2.60 |
| Hydrogen chloride | 9.25 |
| n-Alkyl dimethyl benzyl ammonium chloride | 0.30 |
| n-Alkyl dimethyl ethylbenzyl ammonium chloride | 0.30 |
| Phase stabilizing surfactant per Table II | Per Table II |
| Perfume | 0.10 |
| Water | q.s. 100% |

TABLE II

| Phase Stabilizing Surfactant | Concentration % by Weight | Cloud Point °F. | Stable* |
|---|---|---|---|
| Base Formula | — | 100 | no |
| Coco dimethyl betaine | 0.155 | >190 | yes |
| | 0.62 | >190 | yes |
| Nonylphenoxypoly(ethyleneoxy) | 0.5 | — | no |
| ethanol, HLB = 8.8 | 2.00 | — | yes |
| Nonylphenoxypoly(ethyleneoxy) | 0.50 | 140 | yes |
| ethanol, HLB = 13.0 | 2.00 | 160 | yes |
| Ethoxylated (2 mole EO) | 0.50 | >190 | — |
| coco amine | 2.00 | >190 | — |
| Ethoxylated (5 mole EO) | 0.50 | >190 | — |
| coco amine | 2.00 | >190 | — |
| Ethoxylated (5 mole EO) | 0.50 | >190 | — |
| oleyl amine | 2.00 | >190 | — |
| Ethoxylated (5 mole EO) | 0.50 | >190 | — |
| tallow amine | 2.00 | >190 | — |

*At 125° F. after 28 days.

EXAMPLE 2

The composition of Table I incorporating the surfactant identified in Table III in lieu of the phase stabilizing surfactants were prepared and tested for elevated temperature stability, according to the procedure of Example 1. The elevated temperature stability test results are provided in Table III.

TABLE III

| Surfactant | Concentration % by Weight | Cloud Point °F. | Stable* |
|---|---|---|---|
| Tris-imidazoline tri-quaternary | 0.15 | — | no |
| phosphate ester | 0.60 | — | no |
| Cocoamidopropyl betaine | 0.15 | — | no |
| | 0.60 | — | no |
| Cocoamidopropyl sulfobetaine | 0.25 | 72 | no |
| | 1.00 | >72 | no |
| Oleoamphopropionate | 0.18 | — | no |
| | 0.72 | — | no |
| Cocoamphopropionate | 0.19 | 83 | no |
| | 0.76 | 103 | no |
| Oleoamphopropysulfonate | 0.105 | — | no |
| | 0.42 | — | no |
| Hydroxyethyl oleyl imidazoline | 0.50 | — | no |
| | 2.00 | — | no |
| Proprietary phosphate ester | 0.15 | 93 | no |
| (Phosphoteric T-C6, Mona | 0.60 | 94 | no |
| Industries, Inc.) | | | |
| Coco diethanolamide | 0.50 | <78 | — |
| | 2.00 | <78 | — |
| Ethyoxylated (2 mole EO) coco | 0.50 | 92 | — |
| alkanolamide | 2.00 | <78 | — |

*At 125° F. after 28 days.

EXAMPLE 3

Compositions containing 3.0% dihydroxyethyl tallow glycinate, a surfactant identified below in Table IV, and 0.01% dye, but otherwise identical to the composition of Example 1, were tested for elevated temperature storage stability by visual inspection after storage at 125° F. for 28 days.

TABLE IV

| Surfactant | Concentration % by Weight | Stable* |
|---|---|---|
| N,N—bis(Hydroxyethyl) coco | 0.165 | yes |
| amine oxide phosphate ester | 0.924 | yes |
| Ethoxylated linear alcohol | 0.50 | no |
| ($C_6$–$C_{10}$ alkyl chain, | 2.80 | no |
| 50% ethylene oxide) | | |
| Proprietary phosphate ester | 0.15 | no |
| (Phosphoteric T-C6, Mona | 0.84 | no |

TABLE IV-continued

| Surfactant | Concentration % by Weight | Stable* |
|---|---|---|
| Industries, Inc.) | | |
| Oleoamphopropionate | 0.18 | no |
| | 1.008 | no |
| Oleoamphopropylsulfonate | 0.105 | no |
| | 0.588 | no |

*At 125° F. after 28 days.

EXAMPLE 4

Compositions containing the components identified in Table V and the surfactants listed in Table VI below were prepared and tested for their elevated temperature stability by storage at 125° F. for 28 days as described in Example 1. Test results are tabulated in Table VI.

TABLE V

| Component | % by Weight |
|---|---|
| Dihydroxyethyl tallow glycinate | 1.625 |
| Hydrogen chloride | 8.25 |
| Tetradecyl dimethyl benzyl ammonium chloride | 0.30 |
| Perfume, acid stable | 0.10 |
| Dye, acid stable | 0.01 |
| Water | q.s. to 100%* |

*Adjusted to account for surfactant level.

TABLE VI

| Surfactant | Concentration % by Weight | Stable* |
|---|---|---|
| Coco dimethyl betaine | 0.155 | yes |
| | 0.31 | yes |
| | 0.465 | yes |
| Coco amphopropionate | 0.19 | no |
| | 0.38 | no |
| | 0.57 | no |
| Cocoamidopropyl betaine | 0.15 | no |
| | 0.30 | no |
| | 0.45 | no |

*At 125° F. after 28 days.

EXAMPLE 5

Compositions containing the components identified in Table VII and the surfactants listed in Table VIII were prepared and tested for elevated temperature stability by determination of their cloud points as described in Example 1. The viscosity of each composition was determined using a Brookfield LVT viscometer with a #2 spindle at 60 rpm and at 72° F. The results are provided in Table VIII.

TABLE VII

| Component | % by Weight |
|---|---|
| Ethoxylated tertiary amine per Table VIII* | 2.00 |
| n-Alkyl dimethyl benzyl ammonium chloride | 0.06 |
| n-Alkyl dimethyl ethylbenzyl ammonium chloride | 0.06 |
| Hydrogen chloride | 9.25 |
| Perfume, acid-stable | 0.10 |
| Water | 88.53 |

*Ethoxylated tertiary amines of the general formula

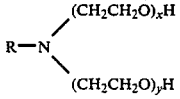

wherein R is alkyl, alkenyl and mixtures thereof and x and y have an average value of from 1 to 3, the sum of x and y being from 2 to 5.

TABLE VIII

| Ethoxylated Tertiary Amine R | (x + y) | Viscosity, centipoise | Cloud Point, °F. |
|---|---|---|---|
| Coco | 2 | <20 | >190 |
| Coco | 5 | <20 | >190 |
| Oleyl | 2 | 165 | <90 |
| Oleyl | 5 | <20 | >190 |
| Tallow | 2 | 175 | <90 |
| Tallow | 5 | <20 | >190 |

It is seen from Table VIII that where R is coco (12–14 carbons in alkyl group) and the sum of x and y is 2 or 5, the ethoxylated tertiary amine raises the cloud point effectively but is unsuitable as a thickener. Where R is an oleyl (18 carbons in alkenyl group) or R is a tallow (18 carbons in alkyl group) and the sum of x and y is 5, the ethoxylated tertiary amine similarly raises the cloud point, but fails to increase viscosity. Conversely, when the sum of x and y is 2 for oleyl and tallow, the ethoxylated tertiary amine is suitable as a thickener but fails to raise the cloud point. When 0.31% coco dimethyl betaine was included in these latter compositions containing the oleyl and the tallow amine having a total of 2 mole ethylene oxide, the resulting compositions each had a cloud point above 190° F.

I claim:

1. An aqueous, thickened acid cleaner composition consisting essentially of on a weight basis:

(a) from about 3 to about 25% hydrochloric acid;

(b) an acid compatible organic thickener agent in an amount effective to provide a viscosity of about 25 centipoise or greater, said organic thickener agent in said effective amount being unsuitable to provide a composition exhibiting thermal stability absent a phase stabilizing amount of a phase stabilizing surfactant;

(c) a germicidally effective amount of a quaternary ammonium compound having the chemical structure $[R_1R_2R_3R_3N]^+X^-$, wherein $R_1$ is an alkyl of from 12 to 18 carbons; $R_2$ is a benzyl or alkyl benzyl, said alkyl having 1 to about 3 carbons; $R_3$ is an alkyl of from 1 to about 3 carbons, and X is a halide anion, (d) a phase-stabilizing amount of a phase-stabilizing surfactant selected from the group consisting of (i) alkyl betaines having the formula

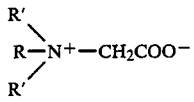

(II)

wherein R is an alkyl of from about 12 to 16 carbons and R′ is methyl or ethyl (ii) alkoxylated tertiary amines having the formula

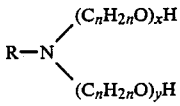

(III)

wherein R is an alkyl or alkenyl of from about 12 to about 14 carbons, n is an integer of 2 to 3, and x and y are integers of from 1 to about 5, the sum of x and y having an average value of from about 2 to about 5;

(iii) ethoxylated alkyl phenol having the formula $$R—\phi—O—(CH_2CH_2O)_nH \quad (IV)$$

wherein R is an alkyl of 6 to 10 carbon and n has a value such that the HLB of the material is about 13 or less, and (iv) is a phosphate ester of an amine oxide having the formula

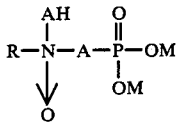

(V)

wherein R is an alkyl of from 12 to 18 carbons; A is $(C_nH_{2n}O)_m$, n having a value of from 2 to about 3 and m having a value of from 1 to about 5, and M is hydrogen or an alkali metal or ammonium cation, and (e) water, said organic thickener agent being a material other than the phase-stabilizing surfactant (d).

2. The composition of claim 1, wherein the phase stabilizing surfactant (d) is coco dimethyl betaine.

3. The composition of claim 1, wherein the phase stabilizing surfactant (d) is an ethoxylated coco tertiary amine.

4. The composition of claim 1, wherein the phase stabilizing surfactant (d) is an octyl or nonyl phenoxy ethoxylate having an HLB of from about 9 to about 13.

5. The composition of claim 1, wherein the phase stabilizing surfactant (d) is N,N-bis(hydroxyethyl) coco amine oxide phosphate ester and its corresponding sodium and potassium salts.

6. The composition of claim 1, wherein the surfactant component (d) is in the range of from about 0.05% to about 2.5%.

7. The composition of claim 1, wherein the thickener agent is selected from the group consisting of (i) dihydroxy($C_1$–$C_3$alkyl) ($C_{16}$–$C_{22}$alkyl) glycinates, (ii) alkoxylated tertiary amines of the formula

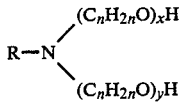

(I)

wherein R is an alkyl or alkenyl group of from 16 to 22 carbons, n is an integer of from 2 to 3, and x and y are integers of from 1 to 3, the average value of x+y in the molecule being 3 or less, and (iii) mixtures thereof.

8. The composition of claim 7, wherein the thickener agent (i) is dihydroxyethyl tallow glycinate.

9. The composition of claim 7, wherein the thickener agent (ii) is an ethoxylated tallow amine having an average of two moles ethylene oxide per molecule.

10. The composition of claim 7, wherein the thickener agent is present in an amount of from about 0.5 to about 5%.

11. The composition of claim 1, wherein the quaternary ammonium compound is present in an amount of from about 0.1 to about 1%.

12. The composition of claim 11, wherein the quaternary ammonium compound is selected from the group consisting of n-alkyl dimethyl benzyl ammonium chloride, n-alkyl dimethyl ethylbenzyl, ammonium chloride, and mixtures thereof.

13. The composition of claim 1 having a cloud point of from about 140° to about 210° F.

14. An aqueous, thickened acid cleaner composition consisting essentially of on a weight basis:

(a) from about 3 to about 25% hydrochloric acid;

(b) an acid compatible organic thickener agent selected from the group of dihydroxyethyl tallow glycinate and ($C_{16}$–$C_{18}$alkyl) diethoxylated tertiary amines having an average of about 2 mols ethylene oxide per molecule, and mixtures thereof, the amount thereof being effective to provide a viscosity of about 25 to about 800 centipoise;

(c) a germicidally effective amount of a quaternary ammonium compound having the chemical structure $[R_1R_2R_3R_3N]^+Cl^-$, wherein $R_1$ is an alkyl of from 12 to 18 carbons; $R_2$ is a benzyl or alkyl benzyl, said alkyl having 1 to about 3 carbons, and $R_3$ is an alkyl of from 1 to about 3 carbons;

(d) a phase-stabilizing amount of a surfactant selected form the group consisting of:

(i) alkyl betaines having the formula

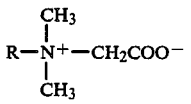

(IIa)

wherein R is an alkyl of from about 12 to about 16 carbons;

(ii) ethoxylated tertiary amines having the formula

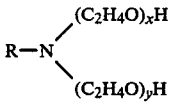

(IIIa)

wherein R is an alkyl of from about 12 to 14 carbons and x and y are integers of from 1 to about 5, the sum of x and y having an average value of from about 2 to about 5;

(iii) ethoxylated octyl and nonyl phenols having an HLB of about 13 or less; and (iv) phosphate esters of an amine oxide having the formula

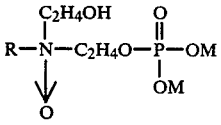

(Va)

wherein R is an alkyl of from 12 to 18 carbons, and M is potassium or sodium, and (e) water.

15. The composition of claim 14, wherein the component (d) is said alkyl betaine, R being a coco group.

16. The composition of claim 14, wherein the component (d) is said ethoxylated tertiary amine, R being a coco group and the sum of x and y having an average value of about 2 to about 5.

17. The composition of claim 14, wherein the component (d) is said ethoxylated octyl or nonyl phenol, the HLB thereof being in the range of from about 9 to about 13.

18. The composition of claim 14, wherein the component (d) is said phosphate ester of an amine oxide, R being a coco group and M being potassium.

19. The composition of claim 14, 15, 16, 17, or 18 wherein the surfactant component (d) is present in an amount of from 0.05 to about 2.5% by weight at the composition.

20. The composition of claim 19, wherein the surfactant component (d) is present in an amount of from 0.15 to 1%.

21. The composition of claim 19, wherein the thickener agent is present in an amount of from about 0.1 to about 5.

22. The composition of claim 21, wherein the thickener is selected from the group consisting of dihydroxyethyl tallow glycinate and diethoxylated tallow tertiary amines.

23. The composition of claim 22, wherein the thickener is present in an amount of from about 1 to about 4% by weight of the composition.

24. The composition of claim 21, wherein the acid is present in an amount of from about 6 to about 15%.

25. The composition of claim 19, wherein the quaternary ammonium compound is selected from the group of n-alkyl ($C_{12}$–$C_{18}$) dimethyl benzyl ammonium chloride, n-alkyl ($C_{12}$–$C_{18}$) dimethyl ethylbenzyl ammonium chloride, and mixtures.

26. The composition of claim 25, wherein the quaternary is present in an amount of from about 0.1 to about 1% by weight of the composition.

27. The composition of claim 26, wherein the alkyl substituent of the quaternary is lauryl.

28. The composition of claim 21, wherein the viscosity of the composition is from about 60 to about 300 centipoise.

29. The composition of claim 19, wherein the hydrochloric acid concentration is from about 6 to about 15%.

30. The composition of claim 14 further including one or more of: a dye; a fragrance; a sequestrant; a builder; a buffer, and an abrading agent.

31. An aqueous, thickened acid cleaner composition consisting essentially of by weight of the total composition:

(a) from about 3 to about 15% hydrochloric acid;

(b) a thickener selected from the group consisting of dihydroxyethyl tallow glycinate, tallow diethoxylated tertiary amine having an average of 2 moles ethylene oxide per molecule, and mixtures thereof, the amount thereof being effective to provide a viscosity of from about 25 to about 800 centipoise;

(c) from about 0.1 to about 1% of a ($C_{12}$–$C_{18}$) alkyl dimethyl benzyl or ($C_1$–$C_3$)alkylbenzyl ammonium chloride;

(d) from about 0.05 to about 2.5% of a phase stabilizing surfactant selected from the group consisting of coco dimethyl betaine; coco diethoxylated tertiary amines having an average of about 2 to about 5 moles ethylene oxide per molecule; ethoxylated octyl or nonyl phenols having an HLB value of between about 9 and 13; N,N-bis(hydroxyethyl) coco amine oxide phosphate ester and its corresponding sodium and potassium salts, and mixtures thereof, and (e) water, said composition having a cloud point of above about 125° F.

32. The composition of claim 30, wherein the thickener agent (b) is present in an amount of from about 1 to about 3%, and wherein the phase stabilizing agent (d) is present in an amount of from about 0.15 to about 1%.

33. The composition of claim 32, wherein the thickener (b) is dihydroxyethyl tallow glycinate and the phase stabilizing surfactant (d) is coco dimethyl betaine.

34. The composition of claim 33, wherein the coco dimethyl betaine is present in an amount of from about 0.15 to 0.50%.

35. The composition of claim 33, wherein the acid concentration is between about 6 to 10%.

36. The composition of claim 31 or 33, wherein the quaternary is lauryl dimethyl benzyl ammonium chloride, lauryl dimethyl ethyl benzyl ammonium chloride, and mixtures thereof.

37. The composition of claim 36, wherein the concentration of the quaternary is from about 0.5 to 0.75%.

38. The composition of claim 32 or 33, wherein the composition velocity is between 60 and 300 centipoise and the cloud point is between 140° and 210° F.

* * * * *